United States Patent [19]

Genuit

[11] Patent Number: 4,741,035

[45] Date of Patent: Apr. 26, 1988

[54] WIDE BAND, LOW NOISE ARTIFICIAL HEAD FOR TRANSMISSION OF AURAL PHENOMENA

[75] Inventor: Klaus Genuit, Aachen, Fed. Rep. of Germany

[73] Assignee: Head Stereo GmbH, Munich, Fed. Rep. of Germany

[21] Appl. No.: 847,145

[22] Filed: Apr. 2, 1986

Related U.S. Application Data

[63] Continuation of Ser. No. 499,933, Jun. 1, 1983, abandoned.

[51] Int. Cl.[4] ..... H04R 5/027

[52] U.S. Cl. ..... 381/26

[58] Field of Search ..... 381/26, 1

[56] References Cited

U.S. PATENT DOCUMENTS

| | | | |
|---|---|---|---|
| 3,969,583 | 7/1976 | Griese et al. | 381/26 |
| 4,119,798 | 10/1978 | Iwahara | 381/26 |
| 4,388,494 | 6/1983 | Schone et al. | 381/26 |

FOREIGN PATENT DOCUMENTS

| | | | |
|---|---|---|---|
| 0050100 | 4/1982 | European Pat. Off. | 381/26 |
| 0056479 | 7/1982 | European Pat. Off. | 381/25 |
| 2437373 | 2/1976 | Fed. Rep. of Germany | 381/25 |

*Primary Examiner*—Forester W. Isen

*Attorney, Agent, or Firm*—Edwin E. Greigg

[57] ABSTRACT

By means of an active filter with free-field sound exposure from the front, a system is provided which assures a frequency response of a microphone's transmission functions which is comparable with that of a measurement microphone, so that this system on the one hand analyzes acoustic phenomena in the conventional manner and, additionally, in the case of reproduction via a free-field, distortion-corrected headset to the eardrums of a listening person, generates the same sound pressure signals as if the person were located at the place of sound recording, while, on the other hand, in the case of reproduction via loudspeakers no annoying acoustic contamination occurs. The entire artifical head system is designed for either a.c. or battery operation and is combined with an analog or digital recording unit to produce a self-sufficient recording and reproduction system.

21 Claims, 14 Drawing Sheets

WIDE BAND, LOW NOISE ARTIFICIAL HEAD FOR TRANSMISSION OF AURAL PHENOMENA

This is a continuation of copending application Ser. No. 499,933 filed June 1, 1983, now abandoned.

BACKGROUND OF THE INVENTION

The invention relates to a dual-channel electroacoustical transmission system as generally defined hereinafter, which may be classified in the category of "artifical-head" recording or transmissions systems.

The term "artifical head" has generally been used in the literature since 1939 and generally refers to any apparatus having at least two microphones in or on a diffraction body not made of flesh, which is similar in shape or dimensions or volume to a human head. The following publication is incorporated hereinwith by reference. Platte, H.-J.: Zur Bedeutung der Aussenohrüber-tragungseigenschaften für den Nachrichtenempfänger "menschliches Gehör" [On the Significance of Outer-Ear Transmission Characteristics for the Information Receiver Represented by the Human Sense of Hearing]. Dissertation at the Technische Hochschule Aachen, Federal Republic of Germany, 1979.

The basic concept of the artificial head, which has been formulated explicitly only recently, may be summarized as follows: Given the suitable transmission of signals from the human auditory canals or by the eardrums, it would have to be possible to stimulate the eardrums of the test person by means of headsets with the same time functions which occur in the original acoustical field without electroacoustical provisions. Since human hearing "sees" its acoustical environment only by means of these eardrum signals, and with a high-fidelity transmission of the eardrum signals of this kind, then all acoustical perceptions (using the terminology of Blauert, called aural phenomena in the following discussion) must likewise be transmitted in a high-fidelity manner; that is, test persons experiencing a transmission of ear drum signals of this kind would have to describe direction, distances, expansions, spatial characteristics and all other characterics of aural phenomena in exactly the same manner, despite the headset reproduction, as if they were actually located directly in the original acoustical field at the location of the artifical head.

The history of the development of the artifical head over more than four decades indicates that the above-discusssed high-fidelity transmission of aural phenomena has not been attained. In many of the early artifical heads, the causes for this are quite obvious from a present-day viewpoint. For instance, holes having the diameter of 35 mm were simply drilled into the head of a store window mannequin in the vicinity of where the ear was attached. The holes, which at that time received microphones of a corresponding size, naturally caused the acoustical effect of the mannequin auricles to appear different as compared with the effect of an intact natural auricle. Accordingly, the directional hearing ears which have been typical for all subsequent artifical heads already occured with this first artifical head, especially the serious error of front/rear transposition, an effect which was noted by the authors at that time but which could not be explained.

Only in the course of time was it recognized that the acoustical effect of the natural auricle lay in the form of a quite complicated directional characteristic, which is important for the "correct" spatial resolution of the acoustical environment by human hearing. The artifical head was accordingly developed further in the course of time in various laboratories, particularly with a view to better simulation of the natural outer ear and to a reduction in size in the microphones to be used. However, up to 1968 no technology was known in which directional hearing errors of a serious nature did not appear. In 1969 Kuerer, Plenge and Wilkens filed a German patent application No. 1,927,401 entitled "Method for the Aurally Correct Recording and Reproduction of Acoustical Phenomena, and Apparatus for Performing it". The inventors equipped a plastic head with ears which had been simulated comparatively accurately, and a high-quality studio microphone was coupled to each of the ear openings via a special acoustical impedance chip simulating the ear drum. As a result of the work of the company Georg Neumann GmbH, Berlin, in the broadcasting field and especially the broadcast of the first artifical head radio play in 1973, there was great enthusiasm both among the public and among program producers for the new, astonishing, natural transmission technology. Although at first it must have appeared that the problem of artifical-head technology had thus been solved, program producers soon complained about annoying acoustical contamination caused by the artifical head and of what they called a "black hole" in front of the artifical head. What was meant by "black hole" was a virtually conical space whose point is located in the center of the head and the axis of which extends parallel to intersecting lines between the horizontal plane and the plane of symmetry of the head; aural phenomena occur either seldom or never within this conical area when the artifical head signals are reproduced via headsets. This observation, which was usually made by the participants without any awareness of further experiments in the field of artifical heads, showed once again that the earlier typical errors of artifical head technology, specifically the front/rear transpositions, still occurred.

Based on the working hypothesis that all previous artifical heads do not satisfy the purely physically-grounded requirement for error-free transmission of ear signals, prior art techniques used an apparatus of sensor microphones, with which sound signals were transmitted from the auditory canals of a living test person and to those of another living test person in a manner which was satisfactory from the standpoint of measurement techniques. In so doing, the "ideal artifical head" of a living test person was used as a substitute for the artifical heads which had been considered by others to be unsatisfactory. Furthermore all the problems are avoided which occur in coupling microphones to the auditory canal of an artifical head in that the recording of sound was realized by means of introducing a thin sensor into the auditory canal of the test person. In hearing tests it was demonstrated that this apparatus achieves not only the high-fidelity transmission of acoustical signals but also a high-fidelity transmission of aural phemonena and thereby for the first time the probability of front/rear transposition was reduced to an amount which is tolerable and is also unavoidable even in natural hearing, that is, not using electroacoustics.

Although the basic functioning of the artifical head principle had been theoretically demonstrated beyond doubt, hardly a single step had been taken closer to the realization of an artificial head capable of high-fidelity transmission. In the time to follow, further details of the questions of outer ear physics which had still been open or were disputed were cleared up, so that fundamental principles could be derived for a high-fidelity artifical head at least in terms of the transmission of spatial aural phenomena. For instance, it was demonstrated that the acoustical impedance of the eardrum or the acoustical input impedance of the auditory canal on the artifical head which was closed off by the eardrum did not necessarily have to be simulated. Asymmetries were found, which were considered typical, in acoustical transmission behavior between the left and right outer ear in test persons. Such asymmetries have not been taken into consideration structurally in previously known artifical heads. In the prior art it has been demonstrated that the acoustical influence of the upper body on the outer-ear directional characteristic, which had previously been considered negligible can be demonstrated by measurement techniques up to frequencies of 1500 Hz. It has been also demonstrated that the acoustical impedance of the human skin had only a negligibly slight influence on the outer-ear directional characteristic.

In 1980, a new artifical head was developed by altering an earlier artifical head. Even this recent artifical head was demonstrated not to meet the above-discussed requirements for an artifical head capable of high-fidelity transmission in every respect: for instance, the miniature electric microphones, Type BT-1759 of the U.S. manufacturer, Knowles, which were used there preclude a dynamic range which is sufficiently wide for high fidelity and preclude a background noise of the artifical head which is sufficiently low for high fidelity. Since it is known that the coupling of the microphones in the artifical head respresents an essential structural characteristic of an artifical head affecting other structural characteristics and itself being dependent on still further characteristics, the artifical head can in no manner be considered to be an essential, inventive solution of the artifical-head problem, lacking only a little additional expense for the sake of noise reduction. As the later German patent application No. P31 01 264.7 demonstrates, more extensive provisions for improvement of the signal-to-noise ratio in a previously known artifical-head system must be considered equivalent to an inventive new solution to the problem, and the signal-to-noise ratio of the artifical head earlier realized is unacceptable for professional electroacoustical recording purposes.

In hindsight, it appeared that with the known artifical head, the question of the signal-to-noise ratio had finally come to be discussed in artifical-head technology as well. For instance, studies confirmed that a practically usable artifical-head recording system absolutely had to have a greater signal-to-noise ratio than any previously known systems had had. These earlier proposals of using a microphone having an outer diameter of approximately 24 mm for an artifical head and coupling this microphone to the end of a conduit approximately 20 mm in length, however, appear problematic in several respects for the purposes of a practical realization. It can also be inferred from the application of artifical-head sterophonics in television, that the background noise of an artifical head suitable for such a purpose must be as low as possible. The reason is that in order to prevent any discrepancy between the angle of hearing and the angle of seeing, the artifical head must be located behind the camera, and if lenses of a long focal length are used the artifical head must be able to accommodate a long recording distance; that is, the head should furnish electrical output signals which are still uncontaminated by noise despite low acoustical signal levels.

Although more recent work appears virtually to be in the direction of how to construct an artifical head, the invention described herein is the first to succeed in providing a wide-band, low-noise artifical head with a wide dynamic range and having the characteristic of high-fidelity transmission of aural phenomena.

OBJECT AND SUMMARY OF THE INVENTION

*It is accordingly the object of the invention to furnish* an artifical head which can be used for applications in measurement techniques and is itself satisfactory from the standpoint of measurement techniques, which satisfies the following individual requirements:

1. The directional characteristic of the outer ear of the artifical head must correspond, except for a basic function not dependent on direction and thus capable of being distortion-corrected, to the outer-ear directional characteristic representative of many test persons.

2. The artifical head must realize the transmission factor which can be concluded from requirement number 1 above over the entire frequency range of human hearing; that is, its upper and lower critical frequencies must be located outside the frequency range of human hearing.

3. The artifical head must operate without audible distortions over the entire dynamic range of human hearing.

4. The power density of the electrical background noise of the artifical head, over the entire hearing frequency range, must either be not or sufficiently little above the noise power density which is equivalent to the human threshold of hearing, so that electrical background noise is not audible.

5. The artifical head must be assigned an adapted filter, the output signals of which represent the interface for reproduction via headsets and via loudspeakers.

6. The headset must be assigned a distortion-correcting filter for the frequency-response adaptation of a headset, which appears to be particularly suitable, to the interface mentioned in requirement 5 above, assuming that no uniform, for instance standardized, transmission function for headsets available on the market has yet been established.

7. The artifical head must be assigned a noise reduction system intended in particular for an analog type recording process.

8. For the intended application in measurement techniques, the artifical head transmission system must be calibratable in its entirety, that is, from the acoustical input of the microphone to the acoustical output of the headset.

9. For the purpose of calibration, the ears of the artifical head must be easily removable from the head and likewise it is must be easy to return them to an assuredly correct predetermined position.

10. The artifical head must be capable of being placed simply in a predetermined alignment with respect to a sound source without using additional accessory means.

11. The electronics which are part of the artifical head must contain a means for switching over to a test tone generator, which after the artifical head microphones have been calibrated—for instance, outside the artifical head—also permits the calibration of the entire remaining electronic system, including the magnetic tape recorder to be used, to a predeterminable transmission factor, for instance a transmission factor 1 for high-fidelity loudspeaker transmission.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
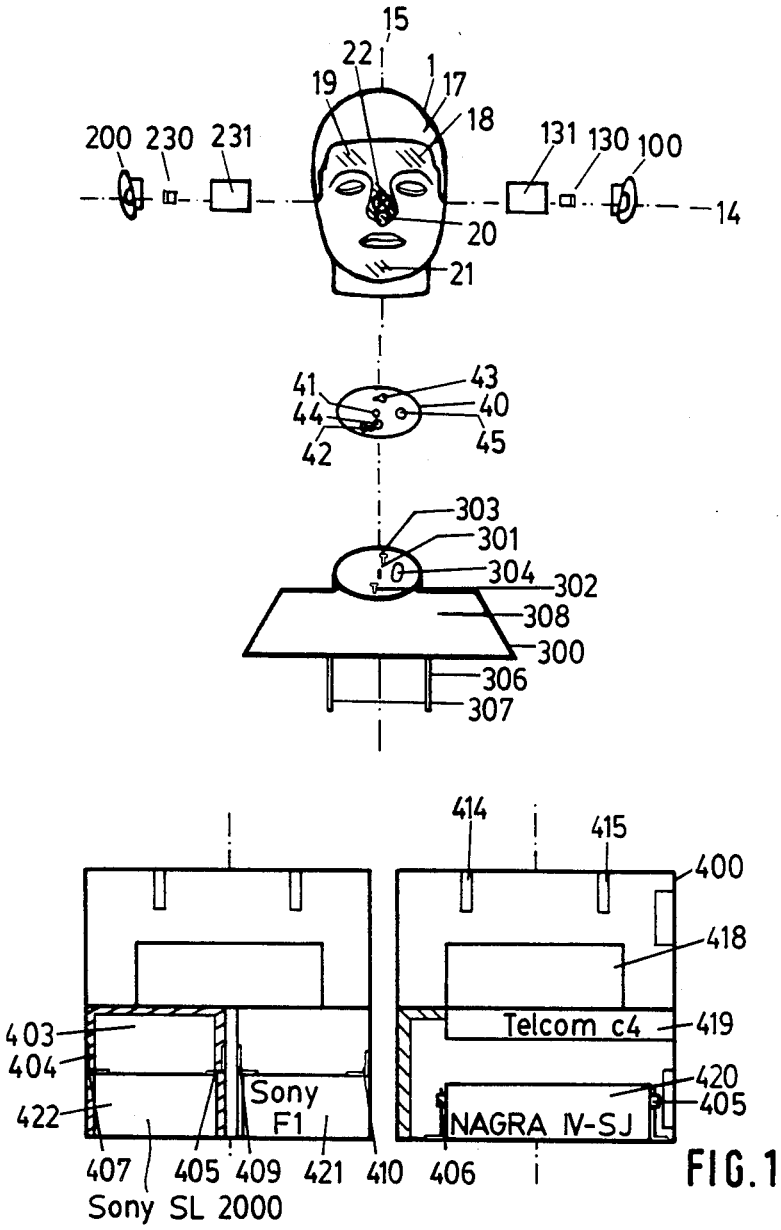
FIG. 1 is an exploded front view of the mechanical components of the artifical head recording system according to the invention.
Figure 2:
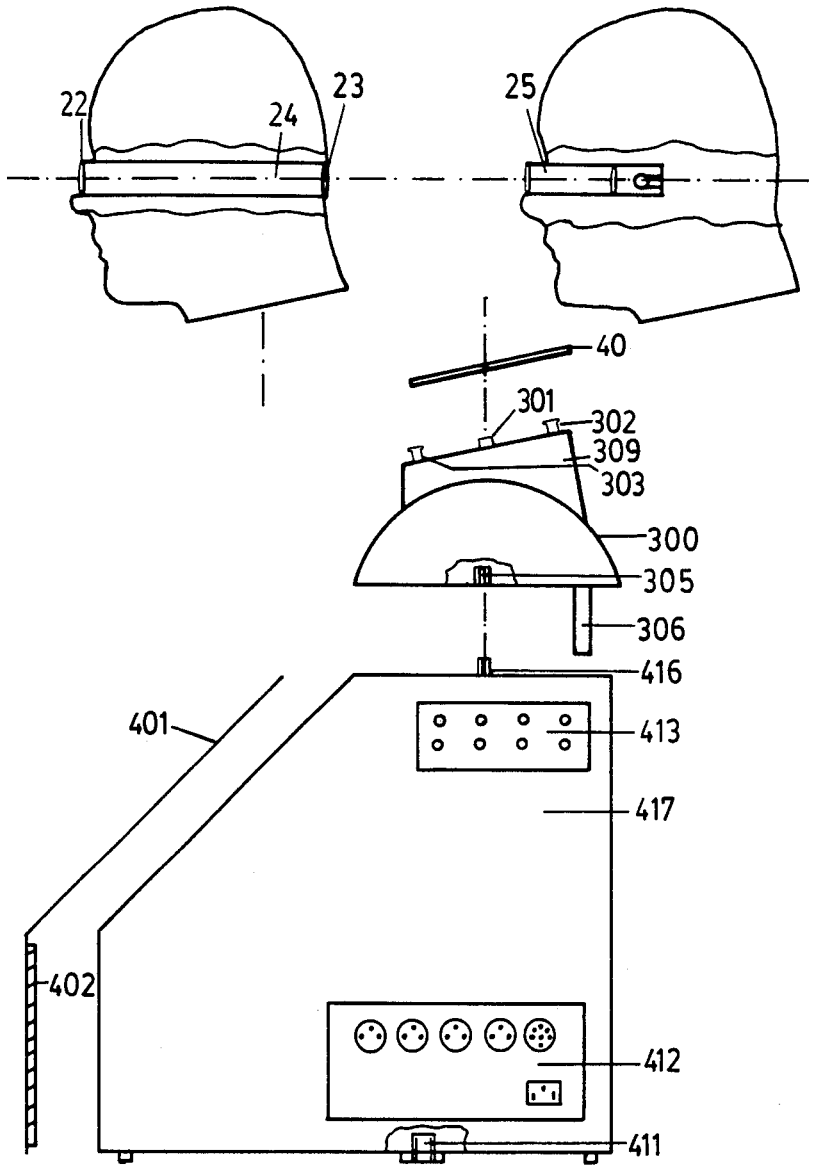
FIG. 2 is an exploded side view of the mechanical components of the artifical head recording system according to the invention.

FIG. 1 shows an exploded front view of the important mechanical components of the artifical head recording system according to the invention, as they appear to the user observing from outside. FIG. 2 shows a corresponding side view. The simulated head 1 has the simulated auricles 102 and 202 on the left and right sides. Each simulated auricle 102, 202 is firmly connected with a cylindrical body 101, 201 and thus forms the respective ear insert 100, 200, which may be removed from the simulated head 1 in a simple manner on each side and can be reinserted equally simply. According to FIG. 1 in the vicinity of the tip of the nose of the simulated head 1, there is an optically transparent point 22, serving as the functional element of an optical projection or direction finding device 25 integrated with the simulated head, and this projection device permits aligning the head with a "target", as a rule a sound source or an acoustical fixed point in the recording chamber. In so doing, the apparatus according to FIGS. 1 and 2 is rotated such that the direction finding or projection device 25 firmly connected to the simulated head 1 projects an optical marking on a given target object.

The photo-optical projection device 25 functions in particular as an optical pointer, which is attached inside the simulated head 1 and connected firmly therewith and projects a light marking on an object or body located at a distance in the direction determined by the alignment of the simulated head 1.

The directional finding device 24,25 connection with the simulated head 1 comprises in particular two openings 22,23, which permit aiming at a distant object. The direction fixed by the direction finding device 24,25 is located preferably in the horizontal plane 14 through auditory canal entrances 116,216 and simultaneously in the acoustical plane of symmetry of the simulated head 1.

As shown in FIGS. 1 and 2, the simulated head 1, which is firmly connected to the base plate 40 of the head, is normally mounted on the simulated shoulder 300 and locked there by means of a quick-clamp connection. The acoustically important geometrical dimensions of the simulated head 1 and of the simulated auricles 102,202 relicate the corresponding dimensions of selected living persons via dimensionally accurate impressions in plastic material. The simulated head 1 represents in particular a dimensionally accurate copy of the head of a test person whose head has dimensions closely approximating the average. The simulated auricles 102,202 represent in particular dimensionally accurate copies of the auricles of a test person whose outer-ear transmission functions are representative of many test persons, and the end 103,203 which is oriented towards the associated simulated auricle 102,202 represents a simulation of the non-flat surface recess of the head of a test person. The simulated shoulder 300 in turn is normally mounted on the chest 400, whereupon the guide rods 306, 307 are passed through the holes 414, 415 into the interior of the chest 400; then the simulated shoulder 300 and the chest 400 are connected with one another by means of a screw 416 and a threaded hole 305. The chest 400 is shaped such that in combination with the simulated shoulder 300, it closely approximates the upper body of a representative test person. The chest 400, as the lower portion of the simulated upper body, contains on the one hand the major portion 418 of the electronics required for operation according to the invention, and on the other hand the space 403 and the fastening means 405, 406, 407, 408, 409, 410 for a small, high-quality magnetic tape recording system, for instance comprising a compander unit 419 and a small analog magnetic tape device 420, or a so-called PCM adapter 421 and a small video recorder 422. The compander system 419, such as TELCOM c4 by AEG-Telefunken is an integral component of the electronic components disposed in the chest 400, making it possible to attain the wide-band, low-noise and wide dynamic range characteristics of the artifical head according to the invention even in the case of reproduction of a recording on an analog magnetic tape. The PCM adapter 421 for recording signals at the output 509, 609 on magnetic tape in the PCM technique is also an integral component of the electronic components disposed in the simulated upper body 300, 400, which makes it possible to attain the wide-band, low-noise and wide dynamic range characteristics in the case of digital storage on magnetic tape as well. In order to prevent the unavoidable mechanical running noises of the tape recording device 420 or 422 from becoming audible in the recording chamber or even being picked up via the microphones 130, 230, the lower space 403 of the chest 400 can be lined with sound-absorbing material 404, and the flap 401 can be provided with acoustical sealing tape 402, so that the lower space 403 of the chest 400, when the flap 401 is closed, forms a soundproof capsule surrounding the magnetic tape unit 420 or 422 which is a source of running noise.

To the side of the chest 400, a group of jacks 412 is provided for effecting the connection of the supply voltage delivery means, the signal output lines and a remote control device for the magnetic tape unit 420 or 422 located in the chest. The recording level indicator 413 also disposed on the chest 400 makes it possible for the user to control the correct recording level of the magnetic tape unit 420 or 422, which during operation is not visible in the chest 400, without further aids. A thread 411 cut into the bottom of the chest 400 serves to secure the chest 400 on a stand.

Figure 4:
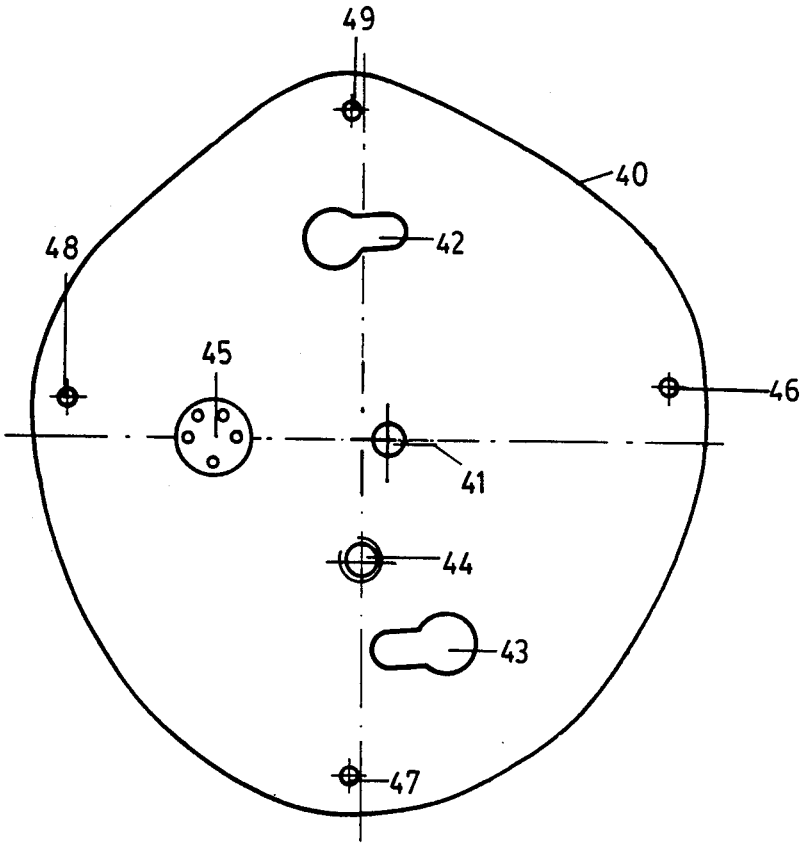
FIG. 4 is a plan view on the base plate of the head.

FIG. 4 shows the base plate 40 of the head, which normally is firmly screwed to the simulated head 1. For connecting the simulated head 1 to the simulated shoulder 300, a centering hole 41 and the bayonet holes 42, 43 are provided in the base plate 40. During the process of mounting the simulated head, with the firmly connected base plate 40, onto the simulated shoulder 300, the simulated head 1 is first moved close enough to the simulated shoulder 300 that the centering pin 301 engages the centering hole 41. As the simulated head 1 is moved closer, it must be twisted about the engaged centering pin 301 such that the bayonet mounting pins 302 and 303 can enter into the bayonet holes 42 and 43. Only in this position can the simulated head 1 be mounted onto the simulated shoulder 300 with the base plate 40 of the head in full surface contact. A rotation in the clockwise direction of the simulated head 1 relative to the simulated shoulder 300 which is performed next connects the two parts with one another as a result of the positive engagement and form-fitting engagement of the bayonet mounting pins 302, 303 with the bayonet holes 42, 43.

Figure 3:
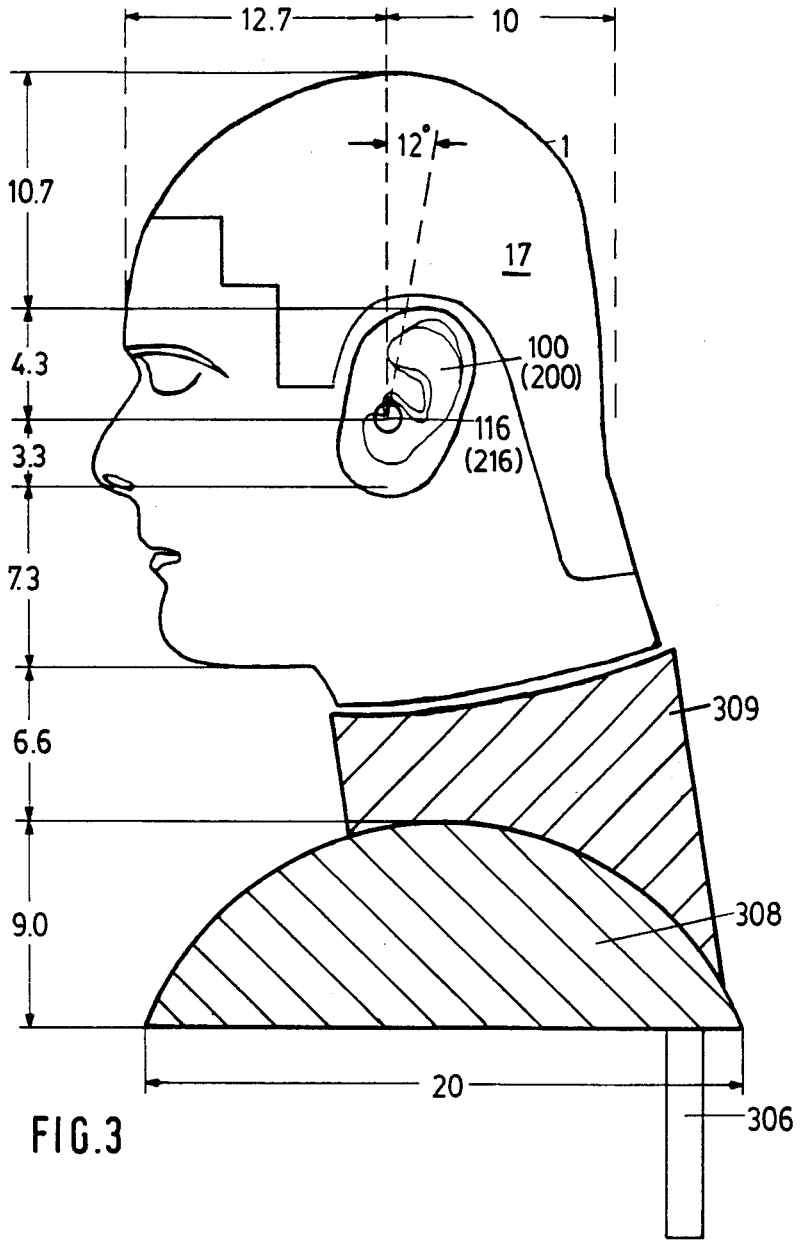
FIG. 3 is a side view from the left of the simulated head, mounted on the simulated shoulder and having the corresponding ear insert.

When all the individual elements are assembled and ready for operation, a multiple-poled plug or a multiple-poled jack 45 is inserted into the hole 45 of the base plate 40 of the head, enabling a quickly released electrical connection of the microphones 130, 230 or impedance convertors 131, 231 accommodated in the interior of the simulated head 1 with the electronics 418 accommodated in the chest 400. The hole 44 in the head base plate 40, having a thread of the conventional type for stands or tripods, is disposed at an angle relative to the normal of the surface such that when screwed together with a vertically disposed stand 50—see FIG. 5—the simulated head 1 assumes the inclination relative to the horizontal and the vertical according to the invention, corresponding to the experimentally ascertained, unforced inclination of the head assumed by a representative test person. The same inclination of the simulated head 1 according to the invention is attained during assembly upon the simulated shoulder 300 positioned on a horizontal surface. FIG. 3 shows a side view of this case.

Figure 6:
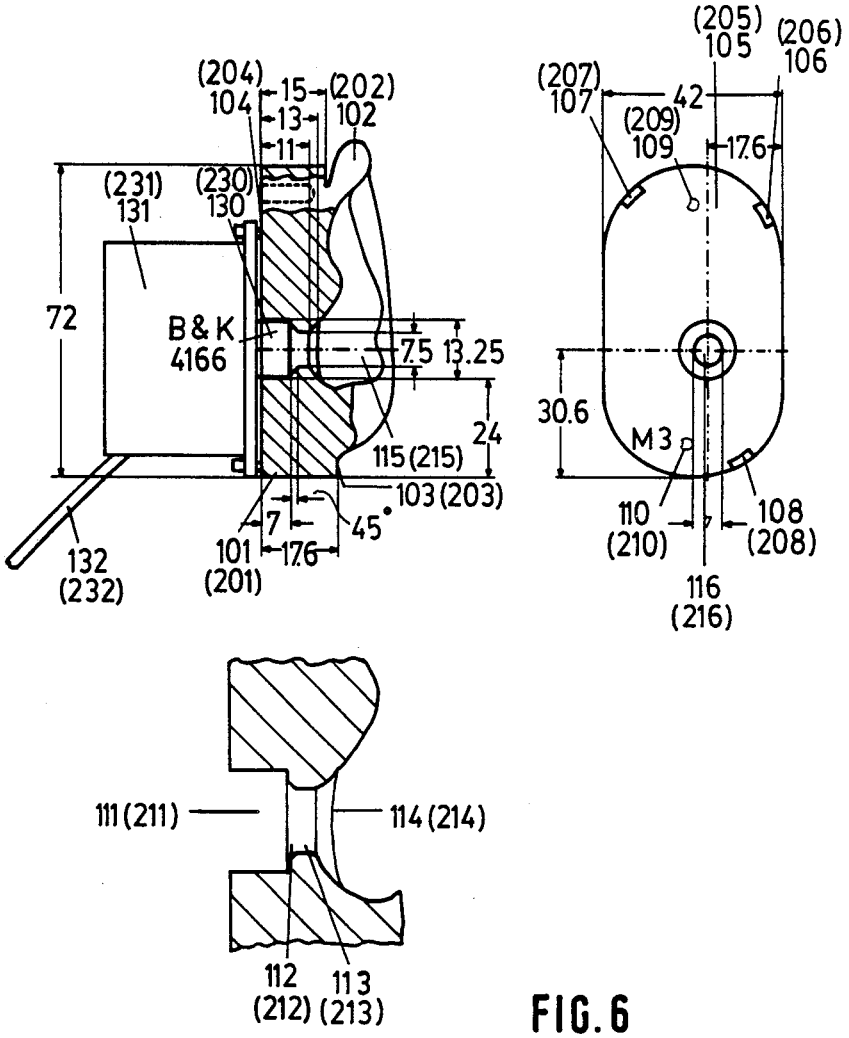
FIG. 6 provides various views of the left ear insert.
Figure 7:
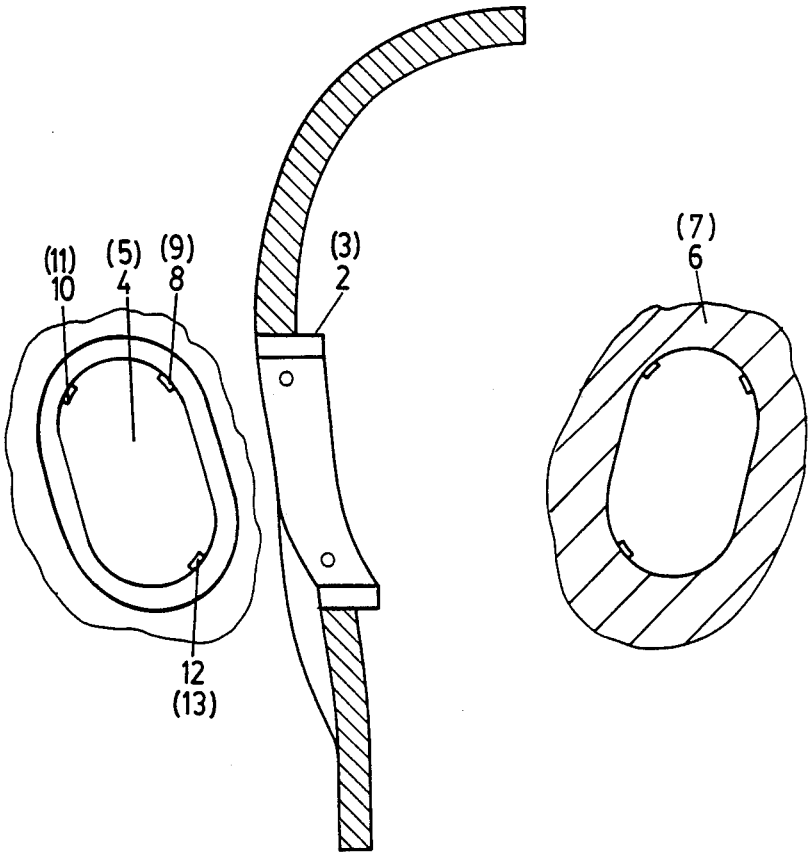
FIG. 7 shows three sections or views for fitting the left ear insert into the simulated head.

FIG. 6 shows the left ear insert 100—which also represents the correspondingly designed right ear insert 200—in various sections and views. FIG. 3 shows the left ear insert 100 in the position according to the invention in the simulated head 1. This position is ascertained by means of a stereometric transmission of the positional relationship between the auricle structure and the reference areas 18, 19, 20, 21 of the face of a representative test person onto the simulated head 1, as shown in FIG. 1. The retention of this positional relationship when an exchange of auricles is simultaneously to be made by the user is assured in the system according to the invention in that the auricle 102 is firmly connected with a cylindrical body 101 having a non-rotationally-symmetrical cross-sectional surface (see FIG. 6), and the cylindrical body 101 is to be inserted into a tube part 4 firmly connected with the simulated head 1 and having a mechanical depth stop (see FIG. 7). The nonrotationally-symmetrical embodiment of the cross-sectional surface of the cylindrical body 101, which acts as a fitting with the cylindrical tube 2, prevents twisting of the simulated auricle 102 counter to its predetermined fixation relative to the geometry of the simulated head 1. The depth stop, realized by means of grooves 106, 107, 108 on the ear insert and counterparts 8, 10, 12 disposed on the simulated head for cooperation therewith, intended for the insertion of the cylindrical body 101 into the tube 2 is disposed such that the simulated auricle 102 is at a distance from the lateral surface of the simulated head corresponding to the distance previously determined in one representative test person. The end surface 103 of the cylindrical body 101 oriented toward the simulated auricle 102, based on a simulation of the corresponding recess in the head surface of a representative test person, has been changed therefrom only to such an extent that after the insertion of the cylindrical body 101 into the associated tube 4 up to the mechanical stop, the outer end surface 103 of the cylindrical body 101 makes a steady transition at all sides to the surrounding surface region 6 of the simulated head 1 (see FIG. 7). A space between an auditory canal entrance 114, 214—defined by the bottom of a primary recess 115, 215 in the simulated auricle 102, 202—and a diaphragm of the microphone 130, 230 coupled to the other end of the cylindrical body 101, 201 is embodied in its volume and its linear dimensions such that an acoustical resonance is established at 12 kHz. Also, the microphone 130, 230 which is used is selected or constructed in terms of its equivalent volume such that an acoustical resonance at 12 kHz is established; The end surface 104 of the cylindrical body 101 remote from the simulated auricle 102 is realized as a receptacle for the microphone 130 and the impedance convertor 131 (FIG. 6). The cylindrical recess 111 in the material receives the microphone 130, which is Type 4166 of the Danish manufacturer Brüel & Kjaer in such a manner that on the one hand a coupling volume 112 predetermined in accordance with the invention and an equally predetermined part 113 of a simulated auditory canal remains, and on the other hand the microphone 130 which is screwed to the impedance convertor 131 is fixed in place by means of the screwing of the impedance convertor 131 to the end face 104 of the cylindrical body 101 in the position according to the invention. The threaded holes 109, 110 receive the fastening screws for the impedance convertor 131. The non-rotationally-symmetrically cross-sectional faces 105, 205 of the cylindrical bodies 101, 201, and the cross-sectional faces 4, 5 of the tube parts 2, 3 are preferably oval.

As already indicated, the space between the microphone 130 and the entrance plane 114 of the simulated auditory canal—comprising the partial spaces of the coupling volume 112 and the part of the auditory canal 113—is selected in terms of its volume and its linear dimensions such that in combination with the acoustical input impedance of the microphone, an acoustical hollow-chamber resonance is established at 12 kHz. This resonance, which is preferably above the upper critical frequency of the microphone 130, is used in accordance with the invention as a means of passive and thus noise-free amplification in order to increase the signal-to-noise ratio in the frequency range of the hollow-chamber resonance or "cavity effect", and in practical terms is thus used for increasing the critical microphone frequency in the artifical-head system as compared with the structurally predetermined upper critical frequency of the microphone 130 during operation in a free sound field.

Figure 5:
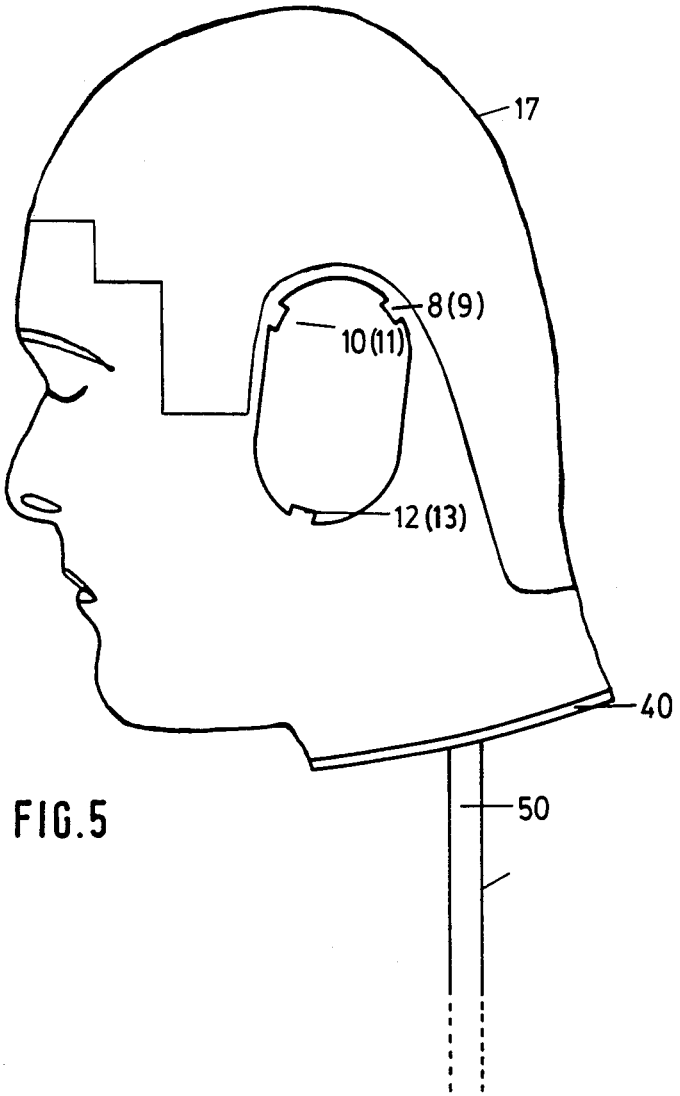
FIG. 5 is a side view of the simulated head, accommodated on a stand and without the ear insert.

The surface of the simulated head 1 corresponding to those parts of a human head which are covered with hair is coated with sound-absorbing material 17 (see FIGS. 1, 3 and 5). The surface of the simulated shoulder 300, in particular the portion of the surface oriented directly toward the simulated auricles 102 and 202, is coated with sound-absorbing material 308. The outer surface of the chest 400 is likewise coated with acoustically absorbent material.

Figure 8:
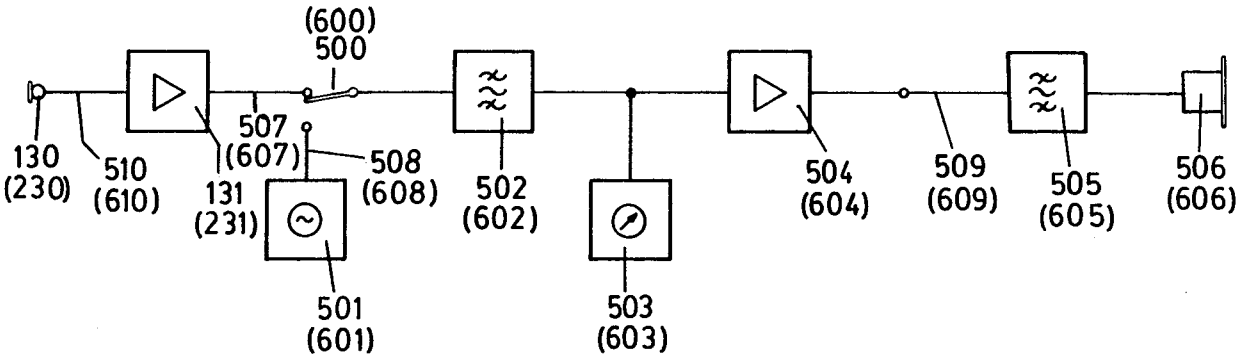
FIG. 8 is a block circuit diagram of the signal-processing artifical-head electronics for the left channel.
Figure 9:
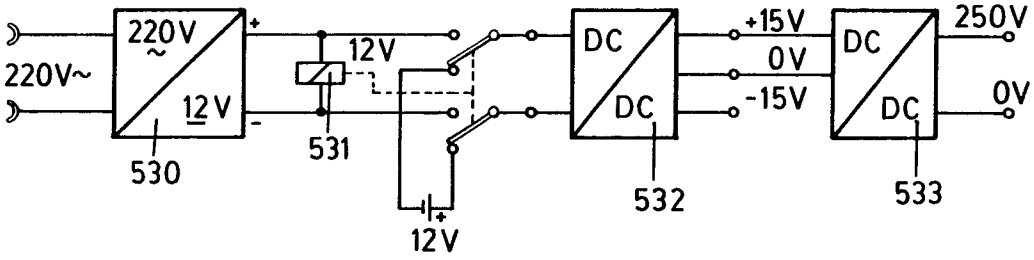
FIG. 9 is a block circuit diagram of the current supply component for the artifical-head electronics.

FIGS. 8 and 9 provide a schematic block circuit diagram for the complete electronics system of the artifical head, comprising the current supply portion of FIG. 9 and two identically designed signal branches corresponding to FIG. 8. The current supply portion of FIG. 9 is operated selectively with either the local mains voltage or from batteries, preferably 12 V batteries. With the aid of the direct-voltage converters 532 and 533, this current supply portion generates the operating voltages required for operating the circuitry shown in FIG. 8. The switchover relay 531 is switched such that when the local mains voltage is applied to the corresponding input of the current supply portion 530, a battery which may be simultaneously connected is separated from the input of the direct-voltage convertor 532, and the signal-processing electronics corresponding to FIG. 8 are supplied from the mains network. If the mains voltage is shut off, the switchover relay 531 automatically switches over to supplying voltage from batteries. The direct-voltage converters 532, 533 for supplying operating voltage in particular to the components 418, 419 from batteries are an integral component of the electronic components accommodated in the simultated upper body 300, 400.

FIG. 8 shows the signal-processing electronics, using the example of the left channel, it being understood that the right channel is designed to correspond fully with it. The left microphone 130 of the system according to the invention is connected with the impedance converter 131, which is disposed in the immediate vicinity inside the simulated head 1, and the output signal of the impedance converter is connected via a cable 132 extending inside the neck of the simulated head with a connection of a reversing switch 500. The reversing switch 500 connects either the output 507 of the impedance converter 131 or the output 508 of a test tone generator 501 with the input of the artifical-head distortion correcter 502. During normal operation, the reversing switch 500 connects the output 507 of the impedance converter 131 with the input of the artifical-head distortion correcter filter 502. The output level of this artifical-head distortion correcter filter 502 is indicated via a peak-value indicator 503 for the purpose of ongoing control of the recording level. The output signal of the artifical-head distortion correcter 502 is amplified, or is converted in its level, for instance on an asymmetrical line having a fixed reference level. Accordingly, the left so-called artifical-head signal is present at the output 509 of the output driver 504 for the purpose of recording or transmission.

The right artifical-head signal is present at the output of a corresponding right-hand electronic system, which in turn comprises the right microphone 230, the right impedance converter 231, the right connection cable 232, the right reversing switch 600, the right artifical-head distortion correcter filter 602, the right test tone generator 601, the right peak-value indicator 603 and the right output driver 604.

After a switchover of the left and right reversing switches 500 and 600, which are coupled with one another mechanically or electrically, the left and right test tone generators 501 and 601 function as substitute voltage sources for the respective combination of a microphone 130 or 230 with an impedance converter 131 or 231. The test tone generators 501 and 601, at a calibrating frequency, introduced in acoustical measuring technology, of 240 Hz, for example, furnish the same output level as the associated impedance converter 131 or 231 when a given microphone 130 or 230 is exposed to an introduced calibrating sound level for instance of 94 dB, in a free sound field. This possible switchover from the microphone to the test tone generator makes it possible for the user of the artifical head to adjust or calibrate the recording or transmission system connected to it such that the transmission factor assumes a predetermined value through the entire system, that is, from the acoustical input signal of the artifical head through to the acoustical output signal of the reproduction converter, for instance the headset 506 and 606. For the case of high-fidelity transmission according to the invention, this transmission factor would have to be precisely equal to 1.

Following a calibration of this kind, the coupled reversing switches 500 and 600 would be brought into the position shown in FIG. 8 for normal operation. The microphone signals pre-processed according to FIG. 8 can then be picked up from the outputs 509, 609 of the output driver 504, 604 and transmitted or recorded on magnetic tape or reproduced via loudspeakers or appropriate headsets. Since at the present time a uniform, for instance standardized, transmission function has not yet become established for headsets available on the market, the artifical-head electronics system 400 contains two headset distortion correcters 505, 605, which are adapted to suitable headsets 506, 606. In accordance with the invention, these headsets are selected or constructed such that they are capable or reproducing the wide dynamic range of the artifical-head recording system according to the invention, in particular at very low and very high frequencies, without audible distortions.

Figure 10:
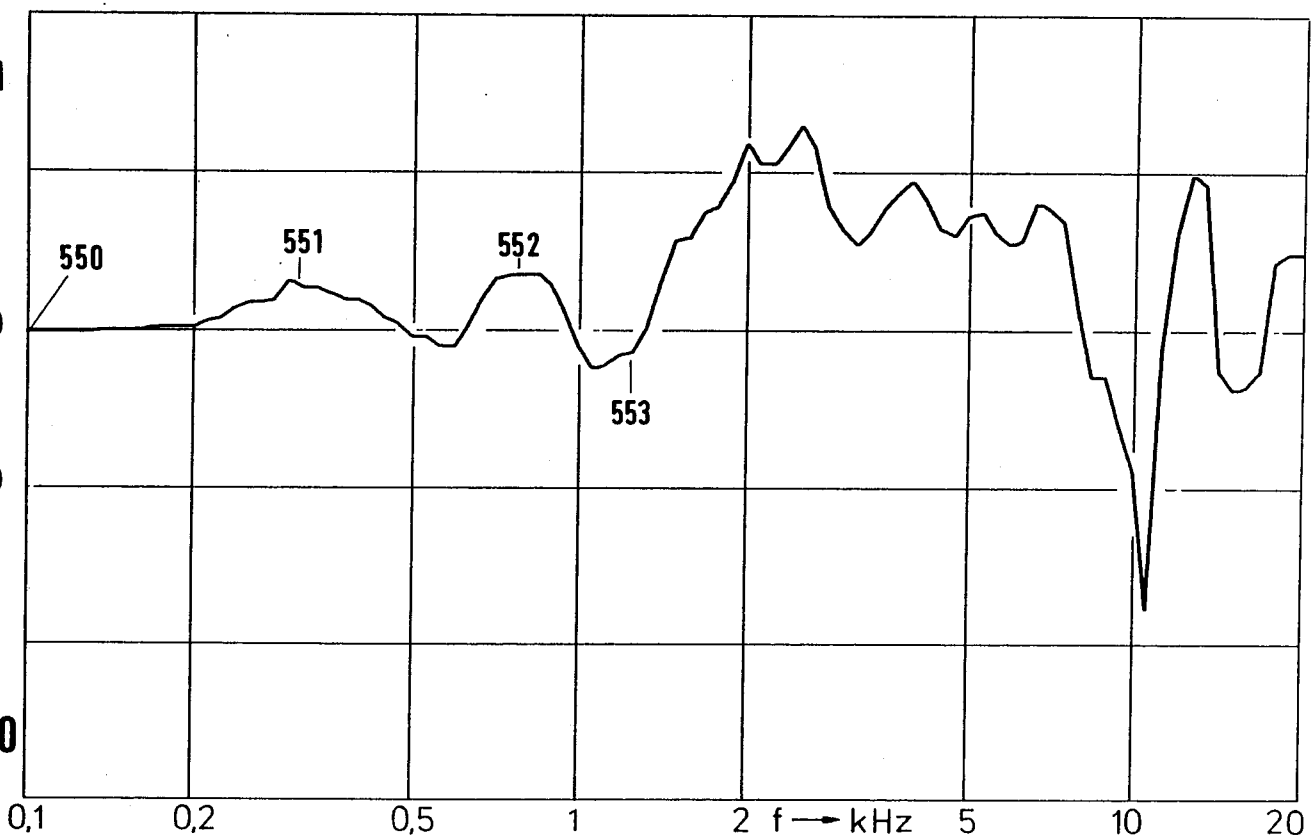
FIG. 10 shows the free-field outer-ear transmission function for sound incidence horizontally from the front, measured in a representative test person.
Figure 11:
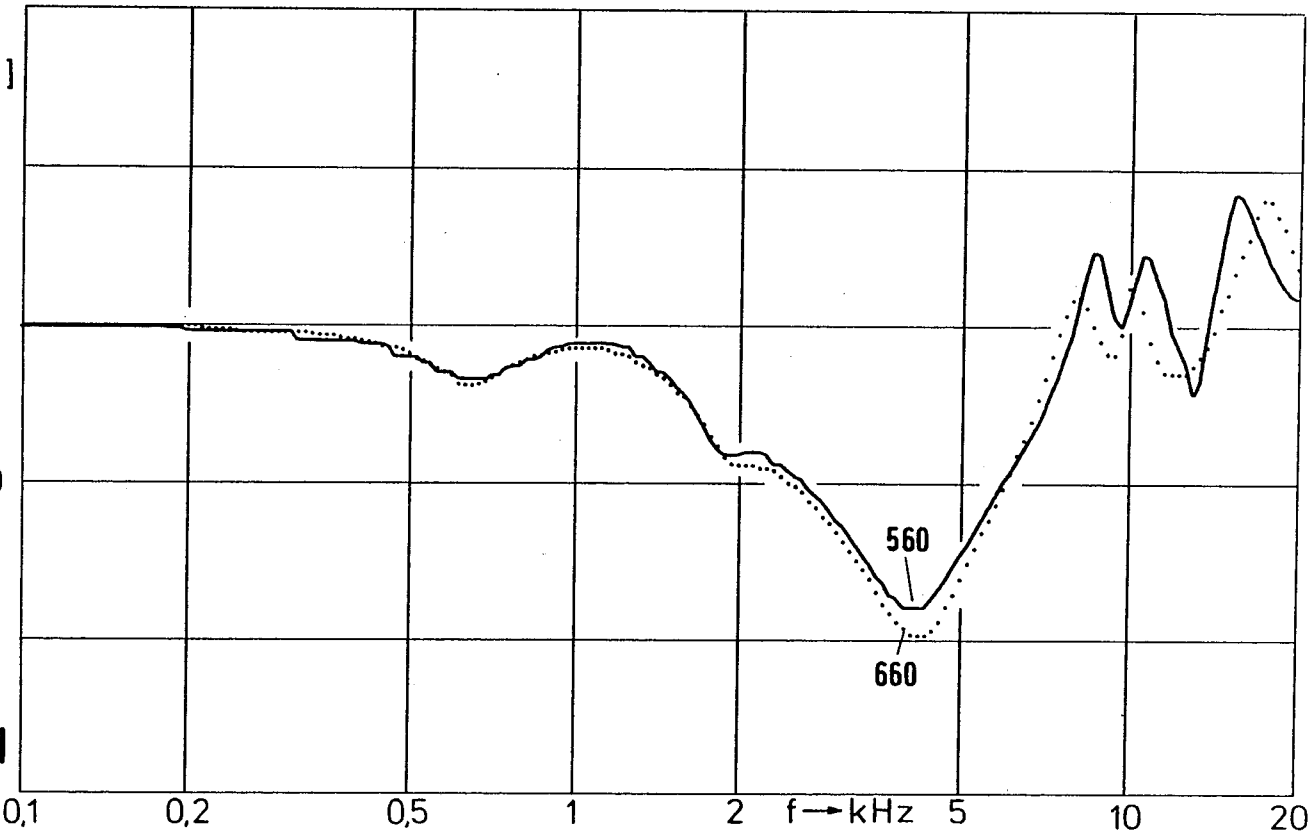
FIG. 11 shows the transmission functions of the artifical-head distortion corrector, seen separately for the left and the right channel.

FIG. 10 illustrates the free-field outer ear transmission function of a representative test person with sound incidence horizontally from the front. It can be seen that there are many characteristic intrusions and emphases, each in terms of a reference line (identified as 0 dB in FIG. 10) predetermined by the transmission constant at low frequencies. The emphases 551 and 552 and the intrusion 553 can be ascribed especially to the acoustical effect of the shoulder. The other structures are produced by the acoustical cooperation of the head, auricle and auditory canal. For the artifical-head recording system according to the invention, there is a requirement among others that the appropriately dimensioned transmission function of the interconnection of the artifical head and the artifical-head distortion corrector must be equal to the representative transmission function of a measuring microphone (for instance, B & K 4134 made by the company of Brüel & Kjaer). From this, the set-point transmission functions 560 and 660 of the artifical-head distortion correcter 502 and 602 are derived. An active distortion correcter network of the structure shown in FIG. 12 may be counted among these set-point transmission functions with a self-approximating digital computer program. FIG. 11 shows the transmission functions 560 and 660 of the artifical-head distortion correcter 502 and 602 measured in the thus-realized system. The known structure of the artifical-head distortion correcter filters 502, 602 shown in FIG. 12 in terms of its circuitry will be described in detail, with reference to Platte above mentioned.

Figure 12:
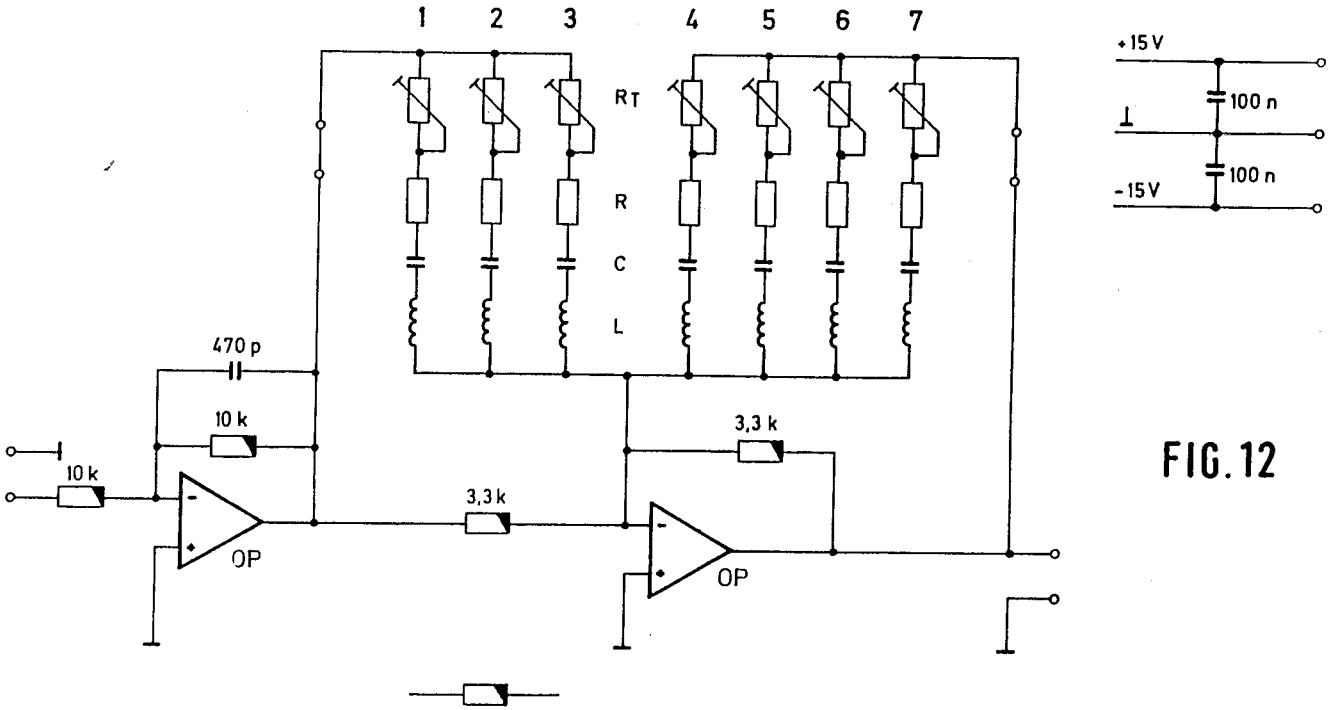
FIG. 12 shows the circuitry of the artificial-head distortion corrector, shown for the left channel only.
Figure 12A:
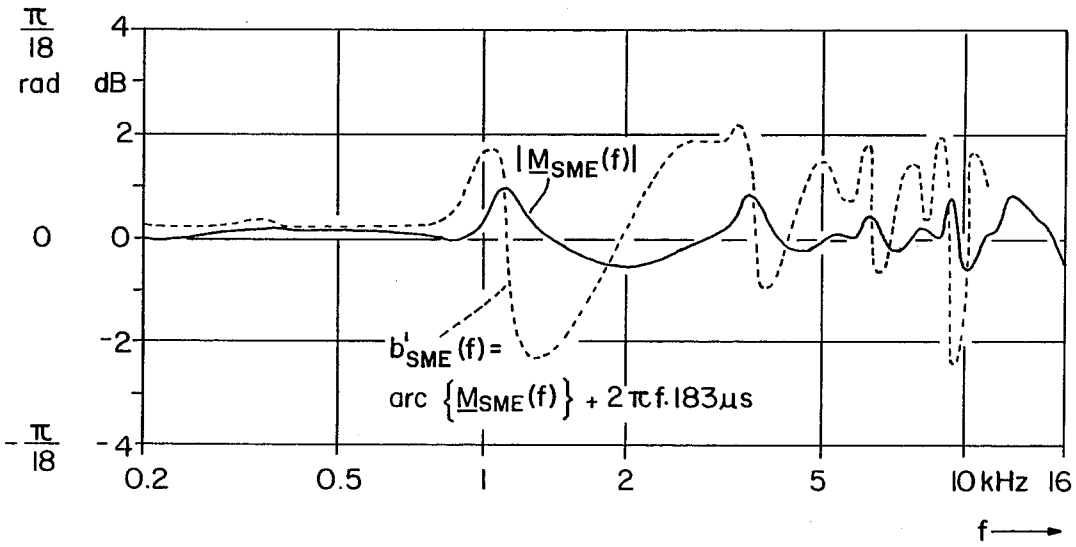
FIG. 12*a* is a graph depicting the transmission function of the distortion corrected microphone probe.

Using the microphone probe in an electroacoustical transmission system necessitates a specialized distortion correction network as shown in FIG. 12, which becomes relatively expensive because of the tube resonances and requires careful tuning. FIG. 12 shows the circuit of this distortion correcter; FIG. 12*a* shows the frequency response curve $M_{SME}(f)$ calculated by magnitude and phase for the distortion-corrected microphone probe.

FIG. 12*a* shows that the distortion-corrected microphone probe differs only slightly, in its transmission function, from an ideally distortion-free delay element (183 μs). In terms of magnitude, these differences are less than 1 dB and in terms of phase less than 7°.

However, staying within these narrow tolerances requires a constant air temperature in the sensor tube, which has been assumed to be 20° C. in the calculations. If for the sake of estimating temperature effects one assumes an extreme case that would virtually never occur, where body heat and the air temperature in the auditory canal would produce uniform heating of the probe to 35° C., then the result would be pronounced mistuning of the individual tube resonance frequencies relative to the resonance frequencies of the corresponding distortion correcter oscillatory circuits (FIG. 12). The result of this mistuning would be that the "distortion-corrected" microphone probe at 35° C. would exhibit substantially more severe damping and phase distortions than at 20° C., with a frequency dependency typical for mistuned resonant circuits of high quality. With an approximation, shown on the left, to every original resonance frequency, the magnitude of the transmission function is at a minimum, while with the approximation shown on the right it is at a maximum. Because of the very steep slopes in this case between these extreme values, long group delay times are inherently involved here. The maximal deviations from ideal transmission behavior are ±4.5 dB for the magnitude at 35° C., and 20° C. for the phase, or 65 μs for the group delay time. Thus it is not generally possible to ignore the actual temperature of the probe in the auditory canal in view of the required accuracy of measurement and the threshold values for audibility of changes in amplitude and group delay time distortions.

In a practical realization, tolerances of $$|20\,|g|M_{SME}(f)|\,| \leqq 2\text{ dB} \qquad (5.1\text{-}13)$$

and $$|\text{arc}|M_{SME}(f)| + 2\pi f 183\ \mu s| \leqq (\pi/18) \quad 10° \qquad (5.1\text{-}14)$$

can be adhered to in the frequency range below 12 kHz, in all measurements.

Figure 13:
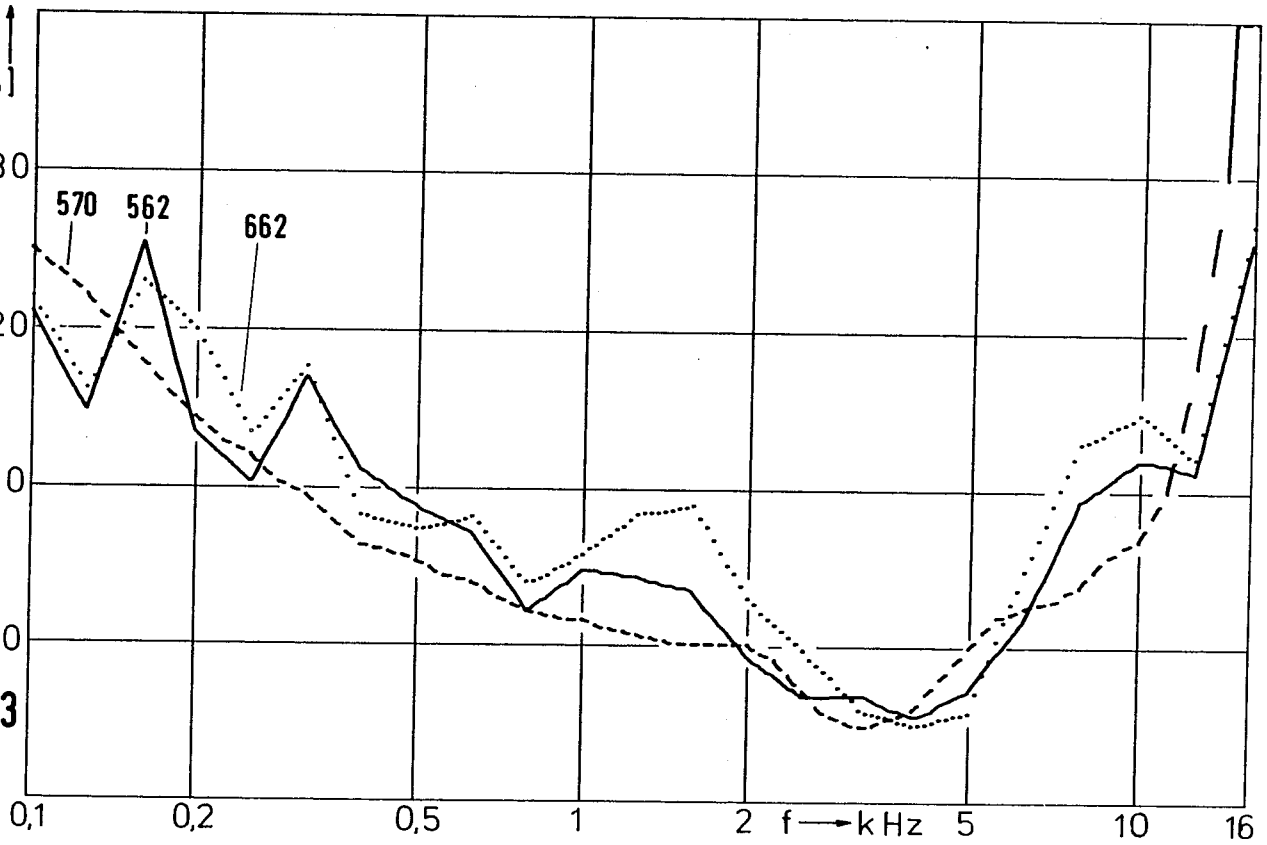
FIG. 13 shows the spectral power density functions of the electrical background noise of the artifical head system, shown separately for the left and the right channels, and the noise power density corresponding to the threshold of hearing.

FIG. 13 shows the spectral noise power densities 562 and 662 of the left and right channel of the artifical-head recording system according to the invention, compared with the nose power density 570 corresponding to the human audible threshold The microphones 130, 230 exhibit sound signals that may have levels in the range of the typical human threshold of pain which do not undergo any audible or disruptive distortions caused by the microphones. It can be seen that the human audible threshold 570 is within the range of a given noise power density 562, 662 of the artifical head recording system; that is, the internal noise of the human auditory system is on the order of magnitude of that of the artifical-head recording system according to the invention. In the middle frequency range between approximately 300 Hz and approximately 10 kHz, the noise power density 562, 662 of the artifical-head recording system, in the present-day form of embodiment described herein, is still up to 5 dB above the noise power density 570 of human hearing; however, this characteristic can be optimized still further in a practical embodiment. The slight differences in noise power density of the left and right channel may be explained on the basis of the slight differences in the transmission functions 560, 660 of the two artifical-head distortion correcters 502, 602. As already described above, each of these distortion correcters, taking into account the left and right artifical-head transmission function ascertained by measurement techniques, is calculated and realized such that the left microphone 130 with the left impedance converter 131 and the left artifical-head distortion correcter 502 approximates the same transmission function 550 for sound incidence horizontally from the front as does the right microphone 230 with the right impedance converter 231 and the right artifical-head distortion correcter 602. FIG. 11 shows the transmission functions 560 and 660 of the left and right artifical-head distortion correcters, respectively.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. An electroacoustical sound recording system, comprising plural microphones disposed in an acoustical diffraction body having acoustically important geometrical structures in the form of simulation means for a head, auricles, at least one shoulder and a chest, said microphones being coupled to an external acoustical field to produce respective electrical output signals, amplification means connected to said microphones for amplifying the output signals, and head phone means arranged to receive the output signals from the amplification means for reproducing high fidelity transmission of aural phenomena, said simulation means being connected with electronic means disposed in said chest, said electronic means including distortion correcting filter means adapted to the simulation means for the head and having selected transmission functions, each simulated auricle being disposed on an outer wall of a carrier body and provided with means defining an opening therethrough adapted to simulate an auditory canal entrance, said carrier body further being provided with an inner wall serving as an adapter for mounting an associated microphone, a simulated auditory canal having a predetermined coupling volume being defined between said simulated auditory canal entrance and said microphone, said simulation means for the head has left and right sides each of which is provided with a tubular receptacle extending into the interior of the head and adapted to receive said carrier body to permit removal and replacement thereof, whereby acoustical high-fidelity transmission having a wide band, a wide dynamic range and low noise comparable to that of human hearing is attained.

2. A system as defined by claim 1, further wherein each tubular receptacle has a depth stop allowing the carrier body to be inserted only to the extent that the outer wall thereof is substantially flush with an outer surface of the simulated head.

3. A system as defined by claim 2, further wherein the depth stops comprise three grooves in each carrier body and three corresponding tangs provided in each tubular receptacle.

4. A system as defined by claim 1, further wherein the carrier body and the tubular receptacle preferably have an ovoid cross-section.

5. A system as defined by claim 1 further wherein when each said carrier body is mounted in its associated tubular receptacle and firmly connected to the simulated head the simulated auricles are located in the same spatial relationship as are the auricles of a human head.

6. A system as defined by claim 1, further wherein the simulated head has an upper surface corresponding to that portion of a human head that is normally covered with hair and that upper surface is coated with acoustically absorbent material.

7. A system as defined by claim 1, further wherein the simulated head is fastened on the simulated shoulder by means of a quick-clamp connection.

8. An electroacoustical sound recording system, comprising plural microphones disposed in an acoustical diffraction body having acoustically important geometrical structures in the form of simulation means for a head, auricles, at least one shoulder and a chest, said microphones being coupled to an external acoustical field to produce respective electrical output signals, amplification means connected to said microphones for amplifying the output signals, and head phone means arranged to receive the output signals from the amplification means for reproducing high fidelity transmission of aural phenomena, said simulation means being connected with electronic means disposed in said chest, said electronic means including distortion correcting filter means adapted to the simulation means for the head and having selected transmission functions, each simulated auricle being disposed on an outer wall of a carrier body and provided with means defining an opening therethrough adapted to simulate an auditory canal entrance, said carrier body further being provided with an inner wall serving as an adapter for mounting an associated microphone, a simulated auditory canal having a predetermined coupling volume being defined between said simulated auditory canal entrance and said microphone, a surface of the simulated shoulder oriented toward the simulated head shaped and disposed at a distance from the simulated auricle such that the emphases of an outer ear transmission function occurring below 1,000 Hz caused in human hearing by the shoulder occur in the system as well, and the outer ear transmission function of the simulated head for specific sound incidence directions has an intrusion of low quality at about 1,100 Hz comparable to that in human hearing, whereby acoustical high-fidelity transmission having a wide band, a wide dynamic range and low noise comparable to that of human hearing is attained.

9. A system as defined by claim 8, further wherein the microphone to be used is selected in terms of its equivalent volume such that an acoustical resonance at substantially 12 kHz is established.

10. A system as defined by claim 9 further wherein, the acoustical resonance at 12 kHz is located in particular above a critical microphone frequency and acts as a passive amplifier connected to the input of the microphones, which amplification upwardly expands the frequency range usable in a free acoustical field with the microphone and increases the signal-to-noise ratio.

11. A system as defined by claim 9, further wherein the microphones have a noise power density which only slightly exceeds the noise power density equivalent to the human audible threshold, whereby the background noise of the microphones is virtually inaudible.

12. A system as defined by claim 11, further wherein the microphones are selected such that sound signals received thereby having levels in the range of the typical human threshold of pain do not undergo any audible or disruptive distortions caused by the microphones.

13. A system as defined by claim 8, further wherein the simulated chest and the simulated shoulder are coated with acoustically absorbent material.

14. A system as defined by claim 13, further wherein the simulated chest carries plugs and jacks for connecting supply lines, output lines and control lines and for connecting a remote-control actuating means for a magnetic tape unit located within the chest.

15. A system as defined by claim 13, further wherein the simulated chest serves as a housing for electrical, electronic, and electromechanical components of the system, and, in particular, as a transportable receptacle for a magnetic tape recording system.

16. A system as defined by claim 15, further wherein operating and functional control indicators are disposed at a location on the head, chest or shoulder simulation means.

17. A system as defined by claim 15, further wherein a respective microphone is provided with an impedance converter, a tone generator and switch means, said tone generator furnishing an output voltage at 240 Hz corresponding to the output voltage of the respective microphone at a fixed sound pressure level at the location of the simulated head, actuation of said switch means allowing said microphone to switch over from receiving an impedance converter output to an output of the tone generator to permit calibration of the subsequent electronic means including a reproduction headset.

18. An electroacoustical sound recording system as claimed in claim 8, wherein the predetermined coupling volume of the simulated auditory canal is dimensioned such that an acoustical resonance is established at a frequency which varies in accordance with operational characteristics of said microphone.

19. An electroacoustical sound recording system, comprising plural microphones disposed in an acoustical diffraction body having acoustically important geometrical structures in the form of simulation means for a head, auricles, at least one shoulder and a chest, said microphones being coupled to an external acoustical field to produce respective electrical output signals, amplification means connected to said microphones for amplifying the output signals, and head phone means arranged to receive the output signals from the amplification means for reproducing high fidelity transmission of aural phenomena, said simulation means being connected with electronic means disposed in said chest, said electronic means including distortion correcting filter means adapted to the simulation means for the head and having selected transmission functions, each simulated auricle being disposed on an outer wall of a carrier body and provided with means defining an opening therethrough adapted to simulate an auditory canal entrance, said carrier body further being provided with an inner wall serving as an adapter for mounting an associated microphone, a simulated auditory canal having a predetermined coupling volume being defined between said simulated auditory canal entrance and said microphone, and the simulated head includes a direction finding device providing an unequivocal receiving point, in a direction predetermined by the geometry of the head, which can be fixed on an object located at a distance in a given direction, whereby acoustical high-fidelity transmission having a wide band, a wide dynamic range and low noise comparable to that of human hearing is attained.

20. A system as defined by claim 19, further wherein the direction finding device comprises at least one aperture which permits aiming at a distant object.

21. A system as defined by claim 20, further wherein the direction fixed by the direction finding device is oriented preferably in a horizontal plane taken through the auditory canal entrances and said at least one aperture.

* * * * *

UNITED STATES PATENT AND TRADEMARK OFFICE

CERTIFICATE OF CORRECTION

PATENT NO. : 4,741,035

DATED : April 26, 1988

INVENTOR(S) : Klaus Genuit

It is certified that error appears in the above-identified patent and that said Letters Patent are hereby corrected as shown below:

On the title page assignee should read:

--[73] Head Stereo GmbH Kopfbezogene
Aufnahme- und Wiedergabetechnik & Co.
Messtechnik KG
D-8000 Muenchen 40
Federal Republic of Germany

Signed and Sealed this

Twentieth Day of September, 1988

*Attest:*

DONALD J. QUIGG

*Attesting Officer*

*Commissioner of Patents and Trademarks*